United States Patent [19]

Nagoshi et al.

[11] Patent Number: 5,055,118

[45] Date of Patent: Oct. 8, 1991

[54] DUST-COLLECTING ELECTRODE UNIT

[75] Inventors: Hitoshi Nagoshi, Tonami; Taizou Kimura; Kazushige Takashima, both of Takaoka, all of Japan

[73] Assignee: Matsushita Electric Industrial Co., Ltd., Kadoma, Japan

[21] Appl. No.: 304,849

[22] PCT Filed: May 19, 1988

[86] PCT No.: PCT/JP88/00474

§ 371 Date: Mar. 21, 1989

§ 102(e) Date: Mar. 21, 1989

[87] PCT Pub. No.: WO88/09213

PCT Pub. Date: Dec. 1, 1988

[30] Foreign Application Priority Data

| | | | |
|---|---|---|---|
| May 21, 1987 | [JP] | Japan | 62-124227 |
| May 21, 1987 | [JP] | Japan | 62-124228 |
| May 21, 1987 | [JP] | Japan | 62-124229 |
| May 21, 1987 | [JP] | Japan | 62-124230 |
| May 29, 1987 | [JP] | Japan | 62-135153 |
| May 29, 1987 | [JP] | Japan | 62-135154 |
| May 29, 1987 | [JP] | Japan | 62-135155 |
| May 29, 1987 | [JP] | Japan | 62-135156 |
| Feb. 16, 1988 | [JP] | Japan | 63-33158 |
| Feb. 16, 1988 | [JP] | Japan | 63-33159 |
| Feb. 16, 1988 | [JP] | Japan | 63-33160 |

[51] Int. Cl.[5] ..... B03C 3/04

[52] U.S. Cl. ..... 55/146; 55/138; 55/155; 55/154

[58] Field of Search ..... 55/138, 155, 146, 154

[56] References Cited

U.S. PATENT DOCUMENTS

| | | | |
|---|---|---|---|
| 4,313,741 | 2/1982 | Masuda et al. | 55/138 |
| 4,477,268 | 10/1984 | Kalt | 55/138 |

FOREIGN PATENT DOCUMENTS

| | | |
|---|---|---|
| 0207203 | 7/1987 | European Pat. Off. . |
| 43-29789 | 12/1968 | Japan . |
| 49-4271 | 1/1974 | Japan . |
| 54-13660 | 6/1979 | Japan . |

*Primary Examiner*—Bernard Nozick

*Attorney, Agent, or Firm*—Cushman, Darby & Cushman

[57] ABSTRACT

A first insulation layer (3), a first conductive layer (1), a second insulation layer (4) and a second conductive layer (2) are laminated, and a larger spacial gap between either one (2) of the first conductive layer (1) and the second conductive layer (2) and the opposite layer (3,4) thereto (2) than that between the other conductive layer (1) and the opposite layer (3,4) thereto (1) is made, and high voltage is applied across both conductive layers (1,2), and when charged dusts pass therethrough, the charged dusts are attached on only one (2) of the conductive layer. These charged dusts are electrically neutralized, and thereby, it becomes possible to prevent weakening of the electric field and declination of the dust-collecting ratio through lapse of time.

5 Claims, 5 Drawing Sheets

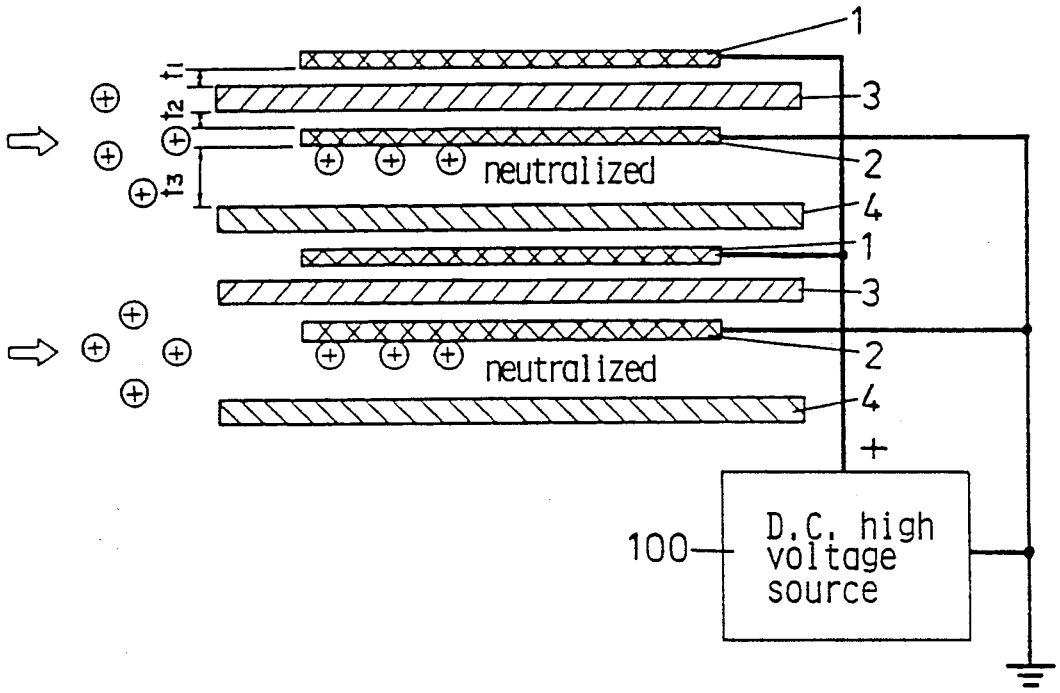
FIG. 2
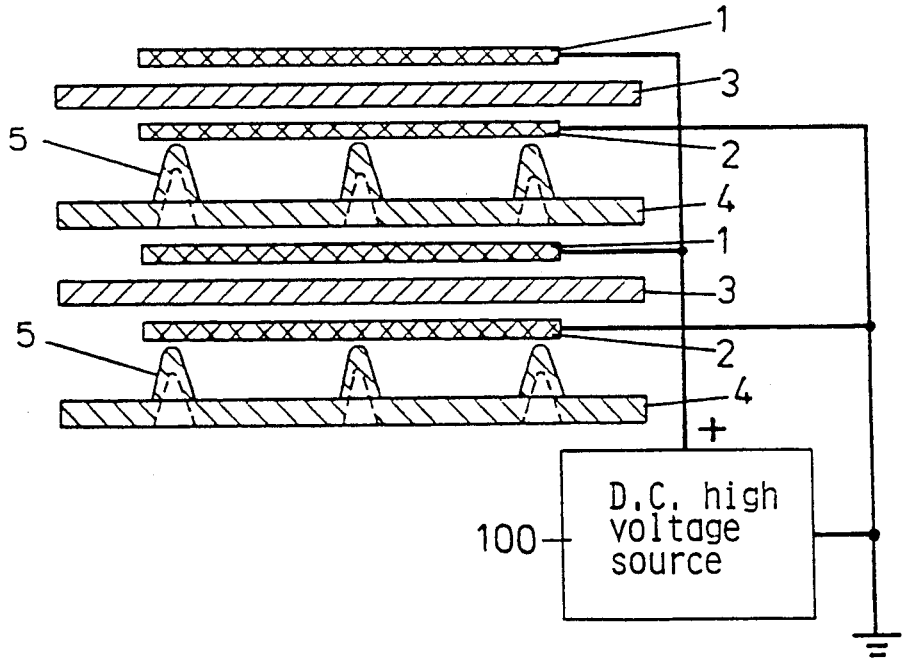

DUST-COLLECTING ELECTRODE UNIT

TECHNICAL FIELD

The present invention relates to a dust-collecting electrode unit of an air cleaner and etc. which charges and collects dusts.

BACKGROUND ART

Heretofore, an example of the air cleaner of this type is constructed as shown in FIG. 10. That is, in a case 81, an ionization unit 84, which comprises ionization wires 82 and ionization electrodes 83, and a dust-collecting electrode unit 87, which comprises dust-collecting electrodes 85 and auxiliary electrodes 86, are provided. In the ionization unit 84, D.C. high voltage is applied from a D.C. high voltage source 100 across each of the ionization wires 82 and each of the ionization electrodes 83, and thereby a corona discharge is made, and dusts are ionized. Ionized dusts are transferred to rear part by means of a fan 88 and pass through the dust-collecting electrode unit 87. In the dust-collecting electrode unit 87, D.C. high voltage is applied from the D.C. voltage source 100 across the dust-collecting electrodes 85 and the auxiliary electrodes 86, and thereby charged dusts are attached on the dust-collecting electrodes 85. However, since each gap between both electrodes 85 and 86 is large, size of the dust-collecting electrode unit 87 undesirably becomes large.

In recent years, a dust-collecting electrode unit as shown in FIG. 11 is proposed to overcome the shortcoming of the above-mentioned dust-collecting electrode unit 87.

That is, films, each of which comprises a first conductive layer 92 provided on a surface of a first insulation layer 91, and films, each of which comprises a second conductive layer 94 provided on a surface of a second insulation layer 93, are alternately laminated with every uniform spacial gaps formed therebetween. Arrows show flowing direction of air.

In the above-mentioned construction, the principle for collecting dusts is described hereafter. In a state such that positive high potential is applied to the first conductive layer 92 and the second conductive layer 94 is grounded, when the dusts, which are charged with positive electricity at a front side of the dust-collecting electrode unit, pass through the dust-collecting electrode unit, the dusts are attached on a surface of the conductive layer 94 of grounded potential and a surface of the second insulation layer 93 by force of Coulomb's law in the electric field, thereby performing dust-collection. The dusts, which are charged with positive electricity and attached on the conductive layer 94 of grounded potential, are electrically neutralized, however, the positive-charged dusts which are attached on the second insulation layer 93 cannot be neutralized, thereby resulting in a state such that the dusts are charged with positive electricity on a surface of the second insulation layer 93. These positive-charged electric charges which are attached on the surface of the second insulation layer 93 act to weaken electric field within each of the spacial gaps between the first conductive layer 92 impressed with positive high potential and the second insulation layer 93, thereby resulting in an undesirable state such that the force of Coulomb's law is weakened and a dust-collecting ratio rapidly lowers as time passes. The above-mentioned description is made with regard to the dusts which are charged with positive electricity at the front side of the dust-collecting electrode unit, but, even when dusts which are charged with negative electricity at the front side of the dust-collecting electrode unit pass through the dust-collecting electrode unit, similar problems will occur.

DISCLOSURE OF THE INVENTION

A main object of the present invention is to offer a dust-collecting electrode unit wherein the charged dusts are not attached on the insulation layer but made intensively attached on the conductive layer, thereby preventing weakening of electric field within each of the spacial gaps between the conductive layer and the insulation layer and preventing declination of the dust-collecting ratio through lapse of time.

The above-mentioned object of the present invention is achieved by laminating at least a first insulation layer, a first conductive layer, a second insulation layer and a second conductive layer in this order, and by making a larger spacial gap between one of the first and second conductive layers and an opposite layer thereto than that between the other conductive layer and an opposite layer thereto.

The dusts, which are charged by the above-mentioned construction, are attached only on a surface of the conductive layer without any attaching on a surface of the insulation layer, and thereby electric field within the spacial gap between the conductive layer and the insulation layer is not weakened, so that rapid declination of the dust-collecting ratio through lapse of time is prevented.

BRIEF DESCRIPTION OF THE DRAWINGS

FIG. 1 is a cross-sectional view showing a dust-collecting electrode unit of a first embodiment of the present invention;

FIG. 2 is a cross-sectional view showing a dust-collecting electrode unit of a second embodiment of the present invention;

BEST MODE FOR CARRYING OUT THE INVENTION

Figure 3:
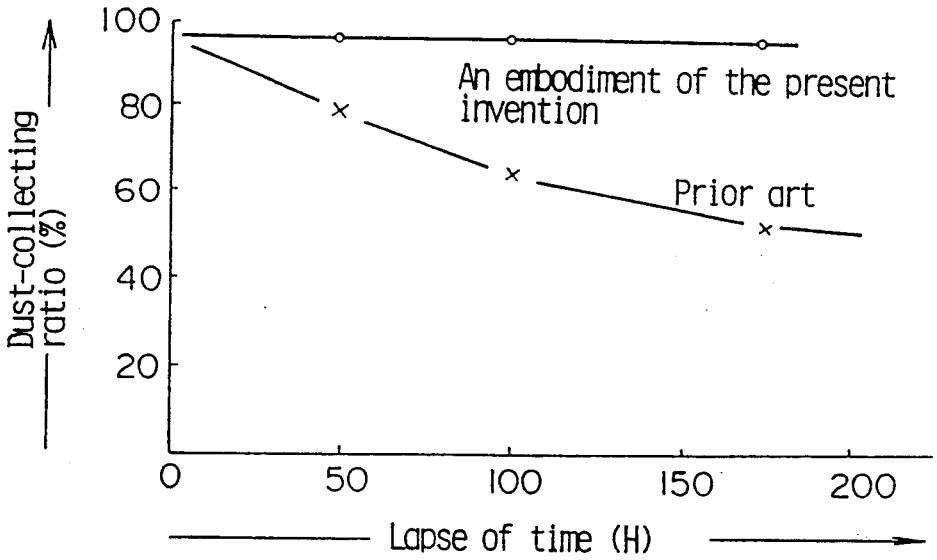
FIG. 3 is a graph showing relation between dust-collecting ratio and lapse of time in accordance with the dust-collecting electrode unit of the above-mentioned embodiment and that of the prior art.

FIG. 1 is a cross-sectional view showing a dust-collecting electrode unit of an embodiment of the present invention.

Numeral 1 designates a first conductive layer made of a metal foil etc., numeral 2 a second conductive layer made of a metal foil etc., numeral 3 a first insulation layer made of a plastic film etc., and numeral 4 a second insulation layer made of a plastic film etc. A spacial gap t3 between the second conductive layer 2 and the second insulation layer 4 is larger in thickness than other spacial gaps t1 and t2. In order to form the large spacial gap t3, for example, projections 5 of dimple-shape are partially formed on the second insulation layer 4 as shown in FIG. 2. Arrows show flowing direction of air.

Next, operation in the above-mentioned construction is described. Since all of the spacial gap between the first conductive layer 1 and the first insulation layer 3, the spacial gap between the first insulation layer 3 and the second conductive layer 2 and a spacial gap between the second insulation layer 4 and the first conductive layer 1 are very much smaller than the spacial gap between the second conductive layer 2 and the second insulation layer 4, the greater part of air, which contains dusts and flows in a direction shown by the arrows, passes through the spacial gap between the second conductive layer 2 and the second insulation layer 4.

In a state such that a positive high potential is applied from a D.C. high voltage source 100 to the first conductive layer 1 of the dust-collecting electrode unit and the second conductive layer 2 is grounded, when dusts which are charged with positive electricity at a front side of the dust-collecting electrode unit pass through the dust-collecting electrode unit, the dusts are attached on a surface of the second conductive layer 2 of grounded potential by force of Coulomb's law in the electric field, thereby performing dust-collection. The dusts, which are charged with positive electricity and attached on the second conductive layer 2 of grounded potential, are electrically neutralized. The above-mentioned description is made with regard to the dusts which are charged with positive electricity from the front side of the dust-collecting electrode unit; but, when dusts which are charged with negative electricity pass from the front side of the dust-collecting electrode unit through the dust-collecting electrode unit, the dusts can be collected on the surface of the second conductive layer 2 by applying grounded potential to the first conductive layer 1 and positive high potential to the second conductive layer 2, and besides, electric charges of the dusts are electrically neutralized.

As mentioned above, according to this embodiment, by making larger spacial gap between either one of the first conductive layer 1 and the second conductive layer 2 and the opposite layer thereto than that between other spacial gaps, the greater part of air passes through the large spacial gap, and thereby the charged dusts are attached only on the surface of the conductive layers but not attached on the surface of the insulation layer, and consequently electric field within the spacial gap between the conductive layers and the insulation layers is not weakened, and a dust-collecting ratio does not lower even through lapse of time.

FIG. 3 shows change of the dust-collecting ratio versus lapse of time in accordance with the embodiment of the present invention and that of the prior art, and this proves that very little declination of the dust-collecting ratio is observed even after lapse of long time, in the embodiment of the present invention.

In the above-mentioned embodiment, although each of the projections 15 is of dimple-shape, it may be gutter-shaped elongated in flowing direction of air, and in short, a configuration which forms a large spacial gap and hardly blocks air-flow is acceptable.

Figure 4:
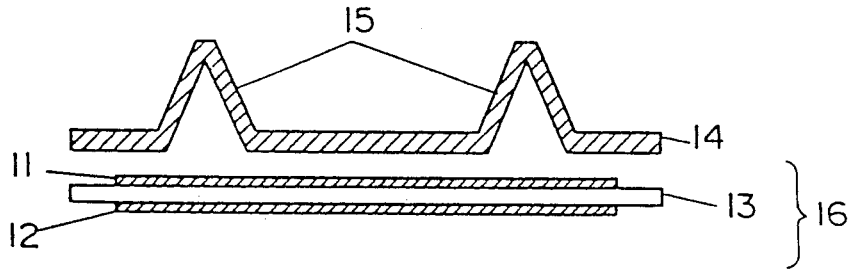
FIG. 4 is a cross-sectional view showing a dust-collecting electrode unit of a third embodiment of the present invention.

In the above-mentioned embodiment, the first conductive layer 1, the first insulation layer 3 and the second conductive layer 2 can be formed by a double-sided metallized film made by evaporation of metal layers on both sides of a belt-shaped insulation film. This example is shown in FIG. 4. In FIG. 4, numeral 13 designates an insulation film which serves as a first insulation layer, and on both sides of this insulation film 13 a first conductive layer 11 and a second conductive layer 12 are formed through metal-evaporation, thereby making a double-sided metallized film 16. Numeral 14 designates a second insulation layer having projections 15 thereon.

Figure 5:
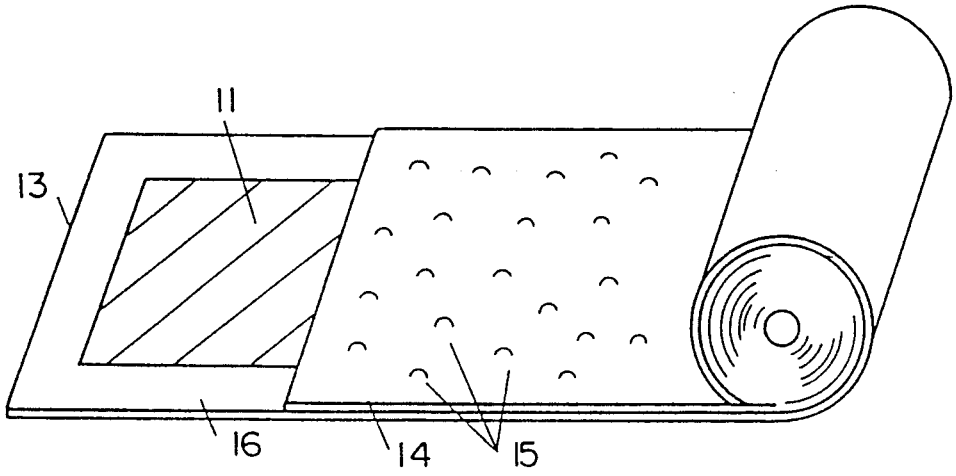
FIG. 5 is a development view thereof.

By making the second insulation layer 14 and the double-sided metallized film 16 into one set of lamination sheet, and by rolling this lamination sheet into a roll of dust-collecting electrode unit as shown in FIG. 5, it is required for one roll of dust-collecting electrode unit only to provide one voltage-supply-terminal to each of the first conductive layer 11 and the second conductive layer 13, thereby simplifying construction.

Also, the dust-collecting electrode unit can be constructed by rolling more than two sets of the above-mentioned lamination sheet.

Figure 6:
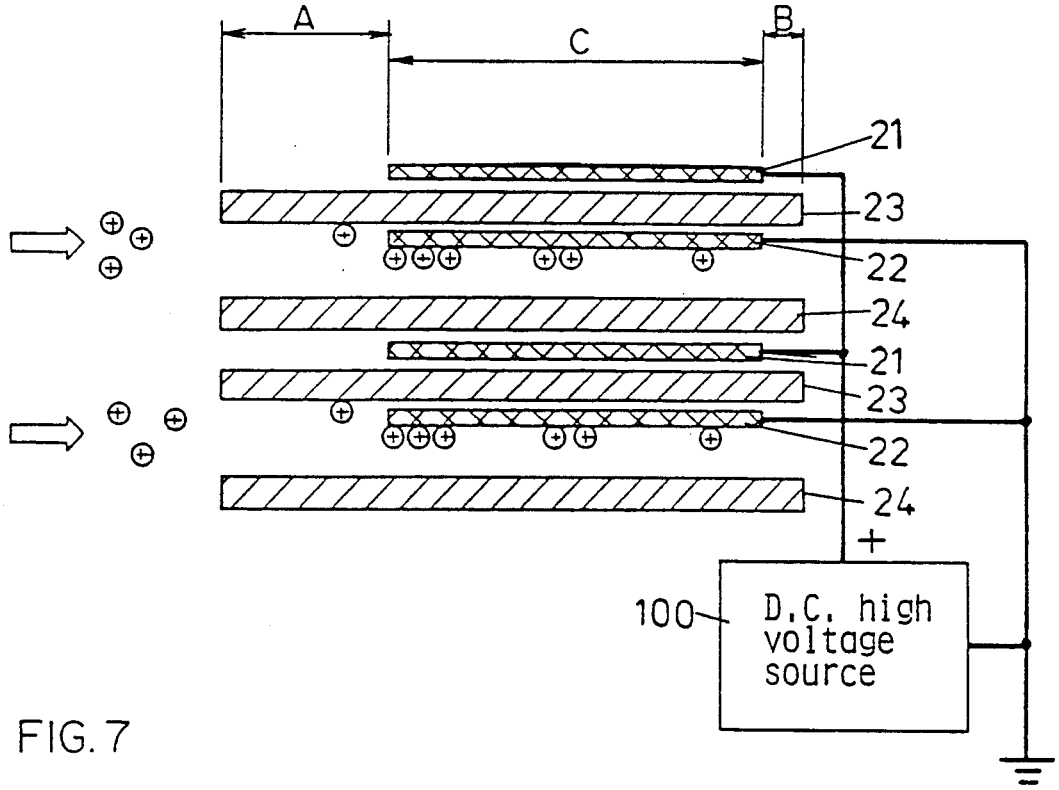
FIGS. 6, 7, 8 and 9 are cross-sectional views which respectively show dust-collecting electrode units of still other embodiments of the present invention.

FIG. 6 is a cross-sectional view showing a dust-collecting electrode unit of another embodiment of the present invention, and numeral 21 designates a first conductive layer, numeral 22 a second conductive layer, numeral 23 a first insulation layer and numeral 24 a second insulation layer. A spacial gap between the second conductive layer 22 and the second insulation layer 24 is larger in thickness than other spacial layers. Letter A designates an insulation-margin part of the windward, letter B an insulation-margin part of the leeward and letter C a width of the first conductive layer 21 and the second conductive layer 22.

In the above-mentioned construction, in the same way as the foregoing embodiment, dusts are attached on the second conductive layer 22, and especially a lot of dusts are attached on a windward part of the second conductive layer 22. In the present invention, since the insulation-margin part A of the windward is larger than the insulation-margin part B of the leeward, a creeping distance between the first conductive layer 21 and the second conductive layer 22 at the windward is long, and thereby dielectric breakdown hardly occur even when a lot of dusts are attached on the windward part.

Figure 7:
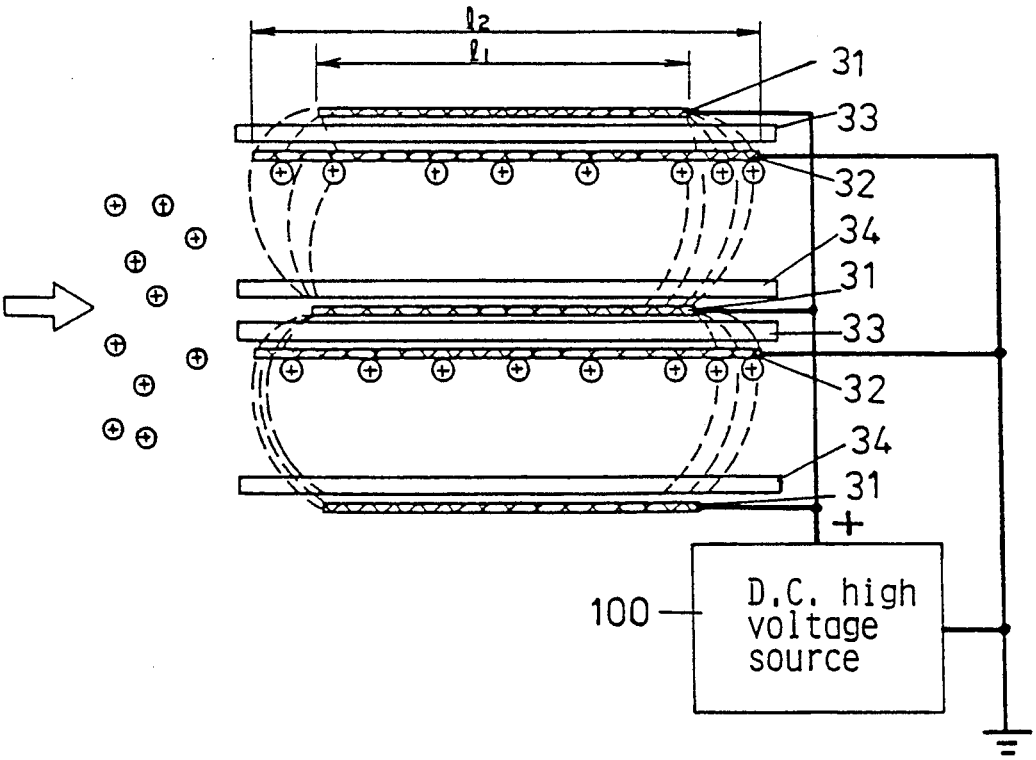

FIG. 7 is a cross-sectional view showing a dust-collecting electrode unit of a still other embodiment, and numeral 31 designates a first conductive layer, numeral 32 a second conductive layer, numeral 33 a first insulation layer and numeral 34 a second insulation layer, and a width l2 of the second conductive layer is larger than a width l1 of the first conductive layer.

In this case, since the width l2 of the second conductive layer 32 is wide, an area for collecting dust is large, and efficiency of dust-collection is increased. Further, there exists an advantage that pressure-loss does not become high.

Figure 8:
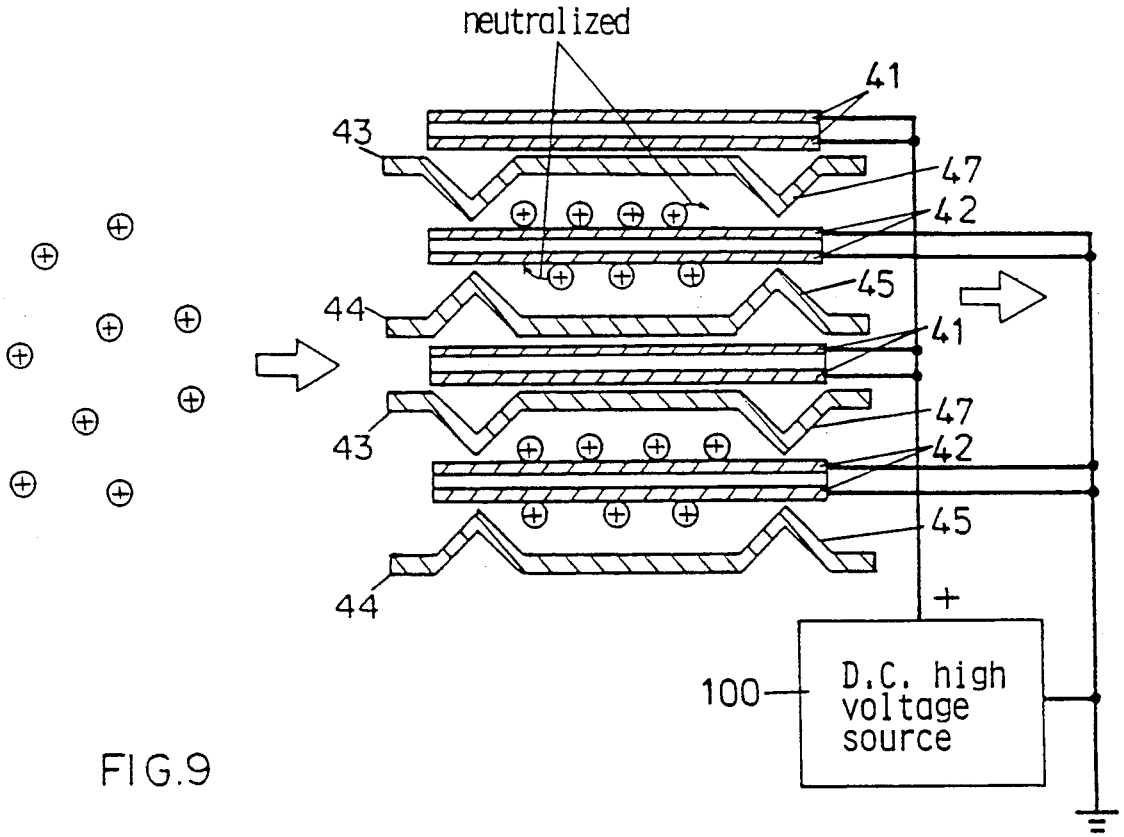

FIG. 8 is a cross-sectional view showing a still other embodiment of the present invention, and numeral 41 designates a first conductive layer which lies on both surfaces of a double-sided metallized film, numeral 43 a first insulation layer having projections 27, numeral 42 a second conductive layer which lies on both surfaces of a double-sided metallized film and numeral 44 a second insulation layer having projections 25, and the projections 45 and 47 are disposed to oppose each other across the second conductive layer 42. One set of lamination body is constructed by these parts, and a dust-collecting electrode unit is formed by wrapping this lamination body.

In the above-mentioned construction, when positive high potential is applied to the first conductive layer 41, and when the second conductive layer 42 is grounded, charged dusts with positive electricity at the front side are attached on the second conductive layer 42 of grounded potential by force of Coulomb's law in the electric field, thereby electrically neutralizing themselves.

Between the double-sided metallized film whereon the first conductive layer 41 is formed and the first insulation layer 43, another insulation film may lie, and also another insulation film may lie between the double-sided metallized film whereon the second conductive layer 42 is formed and the second insulation layer 44.

Figure 9:
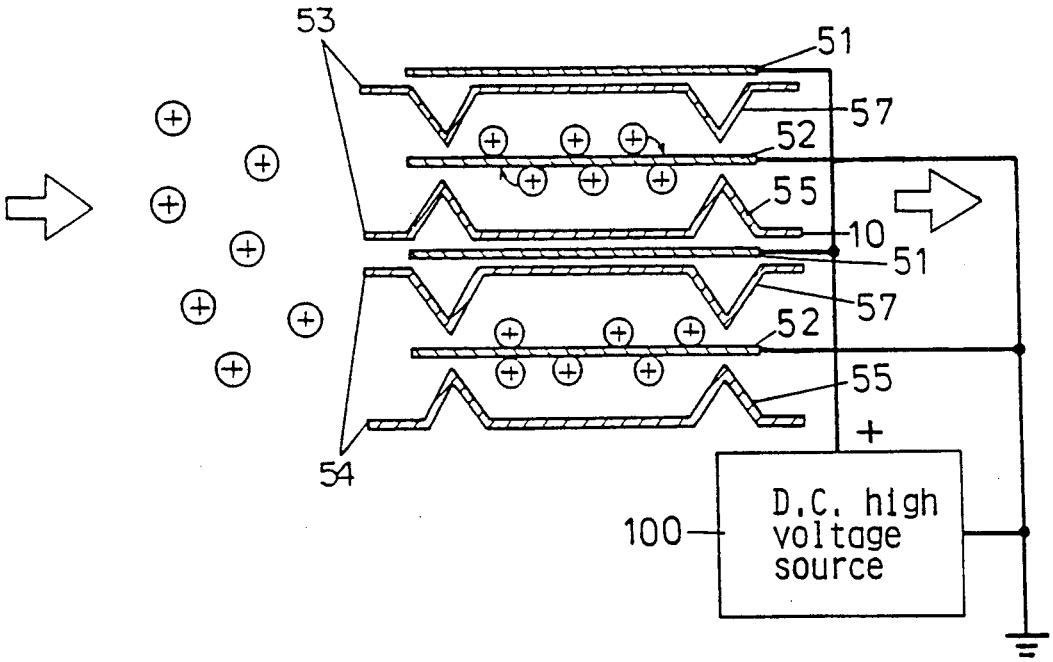
Figure 10:
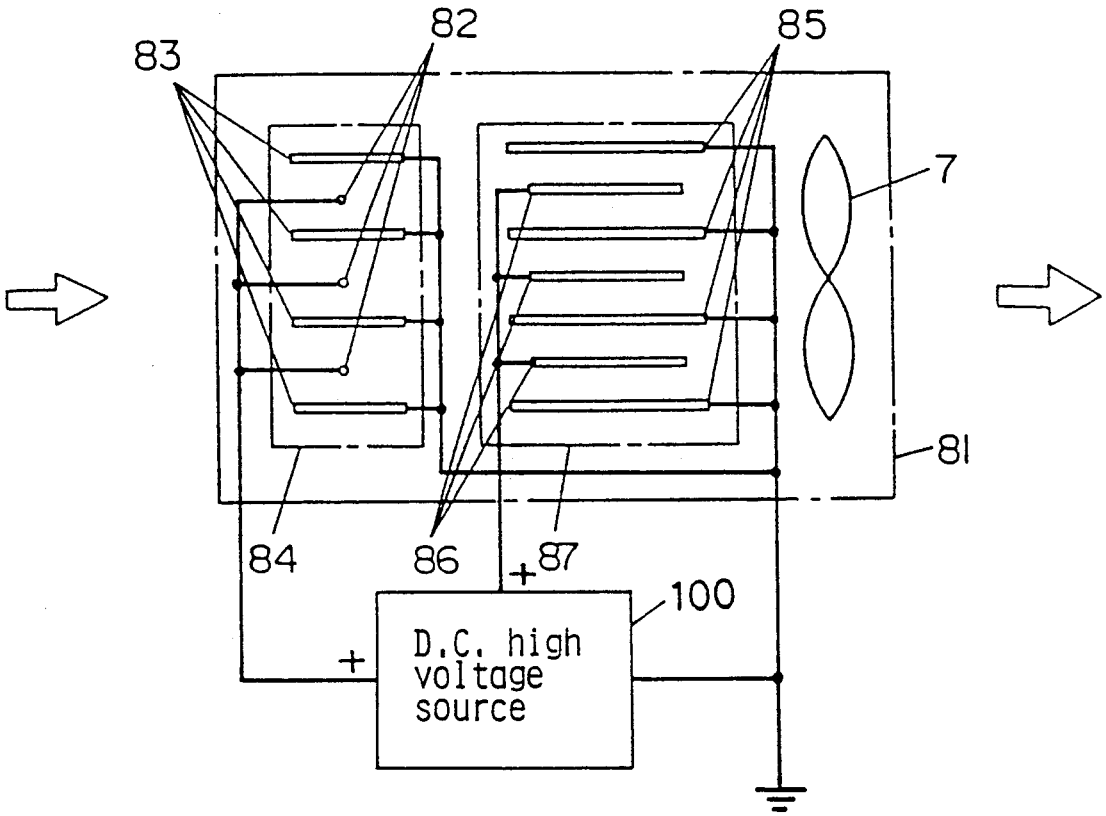
FIG. 10 is the cross-sectional illustration showing the conventional air cleaner.
Figure 11:
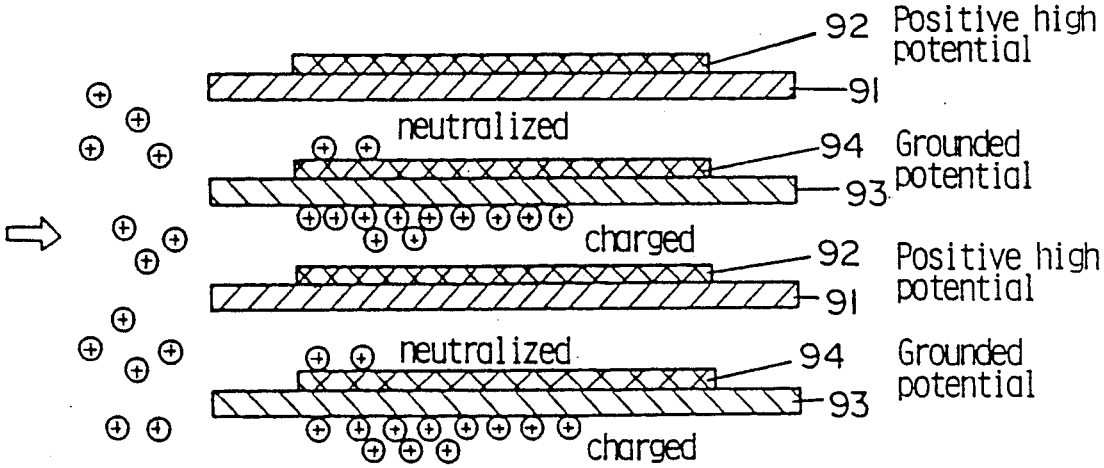
FIG. 11 is the cross-sectional view showing the conventional dust-collecting electrode unit.

FIG. 9 shows a still other embodiment of the present invention, wherein the double-sided metallized film in the embodiment shown in FIG. 8 is substituted by a metal foil.

That is, numeral 51 designates a first conductive layer made of a metal foil, numeral 52 a second conductive layer made of a metal foil, numeral 53 a first insulation layer having projections 57 and numeral 54 a second insulation layer having projections 55. The projections 55 and 57 are disposed to oppose each other across the second conductive layer 52. One set of lamination body is constructed by these parts, and the dust-collecting electrode unit is formed by wrapping this lamination body.

The dust-collecting electrode unit of this embodiment has the same action as the dust-collecting electrode unit of the embodiment shown in FIG. 8.

INDUSTRIAL APPLICABILITY

As described above, by laminating at least the first insulation layer, the first conductive layer, the second insulation layer and the second conductive layer in this order, and by making the larger spacial gap between one of the first and second conductive layers and the opposite layer thereto than that between the other conductive layer and the opposite layer thereto, the charged dusts are attached on only one of the conductive layer, and thereby the charged dusts are electrically neutralized, and as a result, it becomes possible to prevent weakening of the electric field and declination of the dust-collecting ratio through lapse of time.

We claim:

1. A dust-collecting electrode unit having a plurality of lamination units each comprising:

a first conductive layer, a first insulation layer which is stacked on one surface of said first conductive layer without a substantial gap to pass dusts, a second insulation layer, one surface of which is put on the other surface of said first conductive layer without a substantial gap to pass dusts and the other surface of which has plural projections formed thereon, and a second conductive layer which is stacked on said first insulation layer, wherein said lamination units are stacked up with said projections supporting a second conductive layer of a next adjacent lamination unit to thereby form a spacial gap between said second insulation layer and said second conductive layer, said spacial gap being large enough to pass said dusts, and said first conductive layer and said second conductive layer are impressed with a high voltage potential relative to each other from a high voltage source to thereby give said second conductive layer a potential for collecting said dusts.

2. A dust-collecting electrode unit in accordance with claim 1, wherein each of said first insulation layer and said second insulation layer has an insulation-margin part (A) windward of said conductive layers and an insulation-margin part (B) leeward of said conductive layers.

3. A dust-collecting electrode unit in accordance with claim 1, wherein one of said conductive layers is larger in width than the other conductive layer.

4. A dust-collecting electrode unit in accordance with claim 1, wherein said first conductive layer, said first insulation layer and said second conductive layer constitute a double-sided metallized film.

5. A dust-collecting electrode unit in accordance with claim 1, wherein plural projections are formed on both said first insulation layer and said second insulation layer, and said projections are disposed to oppose each other across said second conductive layer.

* * * * *